US006174842B1

(12) United States Patent
Gatto et al.

(10) Patent No.: US 6,174,842 B1
(45) **Date of Patent: *Jan. 16, 2001**

(54) LUBRICANTS CONTAINING MOLYBDENUM COMPOUNDS, PHENATES AND DIARYLAMINES

(75) Inventors: Vincent James Gatto, Midlothian; Edmund F. Perozzi, Glen Allen; Cheng Kuo, Midlothian, all of VA (US)

(73) Assignee: Ethyl Corporation, Richmond, VA (US)

( * ) Notice: Under 35 U.S.C. 154(b), the term of this patent shall be extended for 0 days.

This patent is subject to a terminal disclaimer.

(21) Appl. No.: 09/281,747

(22) Filed: Mar. 30, 1999

(51) Int. Cl.[7] ..... C10M 133/12; C10M 139/06
(52) U.S. Cl. ..... 508/364; 508/563
(58) Field of Search ..... 508/364, 563

(56) References Cited

U.S. PATENT DOCUMENTS

| | | | |
|---|---|---|---|
| 5,605,880 | 2/1997 | Arai et al. | 508/379 |
| 5,650,381 | 7/1997 | Gatto et al. | 508/364 |
| 5,726,133 | 3/1998 | Blahey et al. | 508/390 |
| 5,840,672 | 11/1998 | Gatto | 508/334 |

FOREIGN PATENT DOCUMENTS

| | | | |
|---|---|---|---|
| WO 95/07962 | 3/1995 | (WO) | 141/6 |
| WO 95/07966 | 3/1995 | (WO) | 141/10 |
| WO 95/27022 | 10/1995 | (WO) | 133/12 |

OTHER PUBLICATIONS

SAE Technical Paper Series 981370—A New CNG Engine Test for the Evaluation of Natural Gas Engine Oils, No Date.

SAE Technical Paper Series 981371—New Diesel Engine Oil Category for 1998: API CH–4, No Month.

*Primary Examiner*—Margaret Medley
*Assistant Examiner*—Cephia D. Toomer
(74) *Attorney, Agent, or Firm*—Dennis H. Rainear; Thomas Hamilton; James T. Moore

(57) ABSTRACT

There is disclosed a lubricating oil composition which contains from about 50 to 1000, preferably 50 to 500 parts per million of molybdenum from a molybdenum compound which is oil-soluble and substantially free of reactive sulfur, about 1,000 to 20,000, preferably 1,000 to 10,000 parts per million of a diarylamine and about 2,000 to 40,000 parts per million of a phenate. This combination of ingredients provides improved oxidation control and improved deposit control to the lubricating oil. The composition is particularly suited for use as a crankcase lubricant.

29 Claims, No Drawings

LUBRICANTS CONTAINING MOLYBDENUM COMPOUNDS, PHENATES AND DIARYLAMINES

TECHNICAL FIELD

This invention relates to lubricating oil compositions, their method of preparation, and use. More specifically this invention relates to lubricating oil compositions that contain a molybdenum compound, a diarylamine and an alkaline-earth metal phenate, wherein the molybdenum compound is substantially free of reactive sulfur. The use of the molybdenum compound in combination with the diarylamine and the phenate, within certain concentration ranges, provides a lubricating oil with improved oxidation control, reduced tappet wear and decreased piston, ring and valve deposits.

BACKGROUND OF THE INVENTION

Lubricating oils for internal combustion engines of automobiles or trucks are subjected to a demanding environment during use. This environment results in the oil suffering oxidation which is catalyzed by the presence of impurities in the oil such as iron compounds and is also promoted by the elevated temperatures of the oil during use. This oxidation of lubricating oils during use is typically controlled to some extent by the use of antioxidant additives which may extend the useful life of the oil, particularly by reducing or preventing unacceptable viscosity increases.

We have now discovered that a combination of about 50 to 1000, preferably 50 to 500, more preferably 50 to 250, parts per million (ppm) of molybdenum, based on the total weight of the finished lubricating oil composition, from an oil-soluble molybdenum compound which is substantially free of reactive sulfur; from 1,000 to 20,000, preferably 1,000 to 10,000, ppm of an oil-soluble diarylamine; and from 2,000 to 40,000 ppm of an alkaline-earth metal phenate, is highly effective in inhibiting oxidation in lubricant compositions and providing the lubricating oil with excellent sliding friction characteristics that reduces tappet wear and valve and piston deposits in gasoline, diesel and natural gas (NG) engines.

Lubricant compositions containing various molybdenum compounds and antioxidants, such as aromatic amines, have been used in lubricating oils for some time. Such prior compositions include active sulfur or phosphorus as part of the molybdenum compound, use additional metallic additives or various amine additives which are different from those used in this invention, and/or have concentrations of components that are different than those disclosed by this invention.

Engines have been designed and built specifically for natural gas (NG). These engines are used primarily in stationary applications and are operated under relatively constant operating conditions. Most recently there have been applications of compressed natural gas (CNG) in motor vehicles, especially buses and fleet trucks, due to the economic and environmental benefits associated with NG.

While the basic designs for stationary NG engines and conventional fueled engines (diesel and gasoline) are similar, the differences in operating conditions and maintenance practices have resulted in two distinct lubricant product groups. Stationary NG engine lubricants are usually high viscosity monograde formulations with a low ash content. Conventional fueled engines for vehicles typically use multigrade oils with much higher ash content. The needs of NG engines in transportation applications have not been adequately met by the lubricants presently available and a need exists to design lubricant products that simultaneously fulfill the performance criteria of NG engines in non-stationary applications, gasoline engines and diesel engines. Gasoline and diesel vehicular lubricants are often qualified based on dynamometer tests in a relatively short period of time based upon substantial field experience. However, with the use of an alternative fuel, such as NG, the possibility exists that the performance of accepted oil additives for conventionally fueled engines will be very different in the NG setting. None of the prior art lubricant compositions are directed to solving the special lubricant problems associated with NG engines.

DESCRIPTION OF THE RELATED ART

The prior art discloses the use of molybdenum complexes in lubricating oils, as described in U.S. Pat. No. 3,285,942 to Price et al.; U.S. Pat. No. 4,394,279 to de Vries et al.; U.S. Pat. No. 4,832,857 to Hunt et al.; and U.S. Pat. No. 4,846,983 to Ward. Additional references disclosing lubricating compositions containing molybdenum include U.S. Pat. Nos. 4,889,647; 4,812,246; 5,137,647; 5,143,633; and WO95/07963 to Shaub. However, the prior art has failed to suggest a three-component mixture of molybdenum compounds substantially-free of reactive sulfur, diarylamines and alkaline-earth metal phenates to provide high temperature antioxidant properties and low deposit characteristics to a lubricating oil.

WO95/07962 to Richie et al. and WO95/07966 to Atherton disclose crankcase lubricant compositions for use in automobile or truck engines that contain molybdenum, and amine antioxidants. In addition to the requirement for use of additional elements, these publications recite very broad ranges for concentrations of the molybdenum and the amine. Also, many of the molybdenum compounds of these references contain reactive sulfur, phosphorus, and other elements and the amines disclosed include compounds such as primary amines that are not within the scope of this invention.

U.S. Pat. No. 5,605,880 and WO95/27022 to Arai et al. disclose a lubricating oil composition comprising a specified base oil, an alkyldiphenylamine and/or phenyl-$\alpha$-naphthylamine and an oxymolybdenum sulfide dithiocarbamate and/or an oxymolybdenum sulfide organophosphorodithioates. This reference does not suggest the use of molybdenum compounds substantially free of reactive sulfur in combination with a diarylamine and an alkaline-earth metal phenate to produce an oil additive that creates a lubricating composition that has low friction characteristics, high heat-resistance, a high stability to oxidation, proper viscosity properties, and low deposit formation.

U.S. Pat. No. 5,650,381 to Gatto et al. discloses a lubricating oil composition which contains a molybdenum compound which is substantially free of reactive sulfur, and a secondary diarylamine. U.S. Pat. No. 5,840,672, also to Gatto discloses an antioxidant system that utilizes molybdenum as a component, however, no mention nor suggestion is made that a molybdenum compound substantially-free of reactive sulfur be used with a diarylamine and an alkaline-earth metal phenate.

U.S. Pat. No. 5,726,133 to Blahey et al. discloses a low ash natural gas engine oil and an additive system which is a mixture of detergents. The additive mixture is disclosed as comprising a mixture of detergents comprising at least one first alkali or alkaline earth metal salt or mixture thereof of low Total Base Number (TBN) of about 250 and less, and at least one second alkali or alkaline earth metal salt or mixture thereof which is more neutral than the first low TBN salt. This reference fails to teach molybdenum compounds substantially-free of reactive sulfur for inclusion in the NG engine oil.

SUMMARY OF THE INVENTION

In one aspect, this invention is directed to a lubricating composition comprising (a) a major amount of an oil of lubricating viscosity, (b) at least one oil-soluble molybdenum compound substantially free of reactive sulfur which provides about 50 to 1000 parts per million (ppm) of molybdenum to the lubricating composition; (c) about 1000 to 20,000 ppm of at least one oil-soluble diarylamine; and (d) about 2,000 to 40,000 ppm of at least one alkaline-earth metal phenate detergent.

In another aspect, the present invention is directed to a method for improving the antioxidancy and friction properties of a lubricant by incorporating in the lubricant a molybdenum compound that is substantially free of reactive sulfur, a diarylamine and an alkaline-earth metal phenate in the above described concentrations. This three-component system provides a lubricating oil with highly beneficial properties that are not obtained with combinations of any two of these components alone.

In still another aspect, the invention is directed to a lubrication oil concentrate comprising: a) 10 to 97.5 parts of a solvent; and from 2.5 to 90 parts of a composition comprising b) an oil-soluble molybdenum compound which is substantially free of reactive sulfur; c) an oil-soluble diarylamine; and d) an alkaline-earth metal phenate, wherein the weight ratio of molybdenum from the molybdenum compound to the diarylamine in the concentrate is from about 0.0025 to 1, preferably 0.005 to 0.5, more preferably 0.005 to 0.25, parts of molybdenum for each part of diarylamine and the weight ratio of molybdenum from the molybdenum compound to the alkaline-earth metal phenate is about 0.00125 to 0.5, with 0.00125 to 0.25 being preferred and 0.00125 to 0.125 being most preferred.

In yet another aspect, the invention is directed to a lubricating composition prepared by mixing 50 to 1000, preferably 50 to 500, most preferably 50 to 250, parts per million of molybdenum from an oil-soluble molybdenum compound which is substantially free of reactive sulfur, 1,000 to 20,000, preferably 1,000 to 10,000, ppm of a diarylamine and about 2,000 to 40,000 ppm of at least one alkaline-earth metal phenate, in a natural or synthetic oil, or blends thereof.

The three-component system of the present invention is also very useful in methods to reduce valve deposits, piston deposits, wear, and reduce the formation of varnish and piston deposits in an internal combustion engine. All of these methods can be accomplished through the placement in the crankcase of the internal combustion engine a lubricating oil containing an effective amount of the three-component system according to the invention.

There is also disclosed a crankcase lubricating composition for a natural gas engine comprising:

a) a major amount of lubricating oil;

b) an oil-soluble molybdenum compound substantially free of reactive sulfur;

c) an oil-soluble diarylamine; and d) an alkaline-earth metal phenate.

The compositions of this invention have various uses as lubricants such as for automotive and truck crankcase lubricants as well as transmission lubricants, gear lubricants, hydraulic fluids, compressor oils and NG engine crankcase lubricants.

A key advantage of this invention is the multifunctional nature of the molybdenum/diarylamine/phenate combination and the relatively low treat levels required for a performance benefit. This additive combination provides oxidation control, deposit control and friction control to the oil. This reduces the need for supplemental oxidation protection and friction additives and should reduce the overall cost of the entire additive package. Further cost reduction is gained by the low treat levels employed. Commercial sulfur-containing molybdenum compounds are considerably more expensive than sulfur-free molybdenum compounds. Additional cost savings are gained, therefore, by using sulfur-free molybdenum compounds.

DETAILED DESCRIPTION OF THE INVENTION

As used herein and in the claims the term "oil-soluble molybdenum compound substantially free of reactive sulfur" means any molybdenum compound that is soluble in the lubricant or formulated lubricant package and is substantially free of reactive sulfur. The term reactive sulfur is sometimes referred to as divalent sulfur or oxidizable sulfur. Reactive sulfur also includes free sulfur, labile sulfur or elemental sulfur, all of which are sometimes referred to as "active" sulfur. Active sulfur is sometimes referred to in terms of the detrimental effects it produces. These detrimental effects include corrosion and elastomer seal incompatibility. As a result, "active" sulfur is also referred to as "corrosive sulfur" or "seal incompatible sulfur". The forms of reactive sulfur that contain free, or "active" sulfur, are much more corrosive to engine parts than reactive sulfur that is very low in free or "active" sulfur. At high temperatures and under severe conditions, even the less corrosive forms of reactive sulfur can cause corrosion. It is therefore desirable to have a molybdenum compound that is substantially free of all reactive sulfur, active or less active. By "soluble" or "oil-soluble" it is meant that the molybdenum compound is oil-soluble or capable of being solubilized under normal blending or use conditions into the lubrication oil or diluent for the concentrate. By "substantially free" it is meant that trace levels of sulfur may be present due to impurities or catalysts left behind from the manufacturing process. This sulfur is not part of the molybdenum compound itself, but is left behind from the preparation of the molybdenum compound. Such impurities can sometimes deliver as much as 0.05 weight percent of sulfur to the final molybdenum product.

Oil-soluble molybdenum compounds are prepared by methods known to those skilled in the art. Representative of the molybdenum compounds which can be used in this invention include: glycol molybdate complexes as described by Price et al. in U.S. Pat. No. 3,285,942; overbased alkali metal and alkaline earth metal sulfonates, phenates and salicylate compositions containing molybdenum such as those disclosed and claimed by Hunt et al in U.S. Pat. No. 4,832,857; molybdenum complexes prepared by reacting a fatty oil, a diethanolamine and a molybdenum source as described by Rowan et al in U.S. Pat. No. 4,889,647; a sulfur and phosphorus-free organomolybdenum complex of organic amide, such as molybdenum containing compounds prepared from fatty acids and 2-(2-aminoethyl) aminoethanol as described by Karol in U.S. Pat. No. 5,137,647 and molybdenum containing compounds prepared from 1-(2-hydroxyethyl)-2-imidazoline substituted by a fatty residue derived from fatty oil or a fatty acid; overbased molybdenum complexes prepared from amines, diamines, alkoxylated amines, glycols and polyols as described by Gallo et al in U.S. Pat. No. 5,143,633; 2,4-heteroatom substituted-molybdena-3,3-dioxacycloalkanes as described by Karol in U.S. Pat. No. 5,412,130; and mixtures thereof.

Molybdenum salts such as the carboxylates are a useful group of molybdenum compounds that are functional in the invention. The molybdenum carboxylates may be derived from any organic carboxylic acid. The molybdenum carboxylate is preferably that of a monocarboxylic acid such as that having from about 4 to 30 carbon atoms. Such acids can be hydrocarbon aliphatic, alicyclic, or aromatic carboxylic acids. Monocarboxylic acids such as those of aliphatic acids having about 4 to 18 carbon atoms are preferred, particularly those having an alkyl group of about 6 to 18 carbon atoms. The alicyclic acids may generally contain from 4 to 12 carbon atoms. The aromatic acids may generally contain one or two fused rings and contain from 7 to 14 carbon atoms wherein the carboxyl group may or may not be attached to the ring. The carboxylic acid can be a saturated or unsaturated fatty acid having from about 4 to 18 carbon atoms. Examples of some carboxylic acids that may be used to prepare the molybdenum carboxylates include: butyric acid; valeric acid; caproic acid; heptanoic acid; cyclohexanecarboxylic acid; cyclodecanoic acid; naphthenic acid; phenyl acetic acid; 2-methylhexanoic acid; 2-ethylhexanoic acid; suberic acid; octanoic acid; nonanoic acid; decanoic acid; undecanoic acid; lauric acid, tridecanoic acid; myristic acid; pentadecanoic acid; palmitic acid; linotenic acid; heptadecanoic acid; stearic acid; oleic acid; nonadecanoic acid; eicosanoic acid; heneicosanoic acid; docosanoic acid; and erucic acid. A number of methods have been reported in the literature for preparing the molybdenum carboxylates, e.g., U.S. Pat. No. 4,593,012 to Usui and U.S. Pat. No. 3,578,690 to Becker, both of which are incorporated herein by reference in their entirety.

The nomenclature of the oil-soluble molybdenum carboxylates can vary. Most of the literature refers to these compounds as molybdenum carboxylates. They have also been referred to as molybdenum carboxylate salts, molybdenyl ($MO\ O_2^{2+}$) carboxylates and molybdenyl carboxy late salts, molybdenum carboxylic acid salts, and molybdenum salts of carboxylic acids.

The molybdenum compounds useful in the present invention may be mono-molybdenum, di-molybdenum, tri-molybdenum, tetra-molybdenum compounds and mixtures thereof.

Further, representative molybdenum compounds useful in the present invention include; but are not limited to: Sakura-Lube™ 700 supplied by the Asahi Denka Kogyo K.K. of Tokyo, Japan, a molybdenum amine complex; molybdenum HEX-CEM™ supplied by the OM Group, Inc., of Cleveland, Ohio, a molybdenum 2-ethylhexanoate; molybdenum octoate supplied by The Shepherd Chemical Company of Cincinnati, Ohio, a molybdenum 2-ethylhexanoate; Molyvan™ 855 supplied by the R.T. Vanderbilt Company, Inc., of Norwalk, Conn., a sulfur and phosphorus-free organomolybdenum complex of organic amide; Molyvan™ 856-B also from R.T. Vanderbilt, an organomolybdenum complex. Further, the three-component system of this invention performs very well in reducing the formation of deposits on engine valves and pistons. The concentration of the molybdenum from the molybdenum compound in the lubricant composition can vary depending upon the customer's requirements and applications. The actual amount of molybdenum compound added is based on the desired final molybdenum level in the lubricating composition. From about 50 to, for example, 1000 parts per million of molybdenum (as delivered metal) can be used in this invention based on the weight of the lubricating oil composition which may be formulated to contain additional additives and preferably about 50 to 500 parts per million of molybdenum and particularly 50 to 250 ppm are used based on the weight of the lubricating oil composition. The quantity of additive, e.g., molybdenum carboxylate to provide molybdenum, is based on the total weight of the formulated or unformulated lubricating oil composition. For example, an oil-soluble molybdenum compound containing 8.0 wt % molybdenum content should be used between 0.0625 wt % and 0.3125 wt % to deliver between 50 ppm and 250 ppm molybdenum to the finished oil.

The concentration of molybdenum in the lubricants according to the invention has not particular upper limit, however, for economic reasons a maximum level of 1000 ppm is preferred, while maximum level of 250 ppm is most preferred. As set forth in the experimental section, testing has demonstrated that 100 to 150 ppm molybdenum is highly effective in deposit control. Molybdenum containing additives are expensive and one aspect of the invention is that treatment levels of 50–250 ppm are very effective without adding substantial cost to the lubricant.

The diarylamines useful in this invention are well known antioxidants and there is no particular restriction on the type of diarylamine that can be used. Preferably, the diarylamine is a secondary diarylamine and has the general formula:

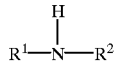

wherein $R^1$ and $R^2$ each independently represents a substituted or unsubstituted aryl group having from 6 to 30 carbon atoms. Illustrative of substituents for the aryl group include aliphatic hydrocarbon groups such as alkyl having from about 1 to 30 carbon atoms, hydroxy groups, halogen radicals, carboxyl groups or nitro groups. The aryl is preferably substituted or unsubstituted phenyl or naphthyl, particularly wherein one or both of the aryl groups are substituted with at least one alkyl having from 4 to 30 carbon atoms, preferably from 4 to 18 carbon atoms. It is further preferred that both aryl groups be substituted, e.g. alkyl substituted phenyl.

The diarylamines used in this invention can be of a structure other than that shown in the above formula that shows but one nitrogen atom in the molecule. Thus, the diarylamine can be of a different structure provided that at least one nitrogen has 2 aryl groups attached thereto, e.g., as in the case of various diamines having a secondary nitrogen atom as well as two aryls on one of the nitrogens.

The diarylamines used in this invention should be soluble in the formulated crankcase oil package. Examples of some diarylamines that may be used in this invention include: diphenylamine; various alkylated diphenylamines, 3-hydroxydiphenylamine; N-phenyl-1,2-phenylenediamine ; N-phenyl-1,4-phenylenediamine; dibutyldiphenylamine; dioctyldiphenylamine; dinonyldiphenylamine; phenyl-alpha-naphthylamine; phenyl-beta-naphthylamine; diheptyldiphenylamine; and p-oriented styrenated diphenylamine, mixed butyloctyldiphenylamine, and mixed octylstyryldiphenylamine.

Examples of commercial diarylamines include, for example, Irganox® L06 and Irganox® L57 from Ciba Specialty Chemicals; Naugalube® AMS, Naugalube® 438, Naugalube® 438R, Naugalube® 438L, Naugalube® 500, Naugalube® 640, Naugalube® 680, and Naugard® PANA from Uniroyal Chemical Company; Goodrite® 3123, Goodrite® 3190X36, Goodrite® 3127, Goodrite® 3128, Goodrite® 3185X1, Goodrite® 3190X29, Goodrite® 3190X40, and Goodrite® 3191 from BF Goodrich Specialty Chemicals; Vanlube® DND, Vanlube® NA, Vanlube® PNA, Vanlube® SL, Vanlube® SLHP, Vanlube® SS, Vanlube® 81, Vanlube® 848, and Vanlube® 849 20 from R.T. Vanderbilt Company, Inc.

The concentration of the diarylamine in the lubricating composition can vary depending upon the customer's requirements and applications. In a preferred embodiment of the invention, a practical diarylamine use range in the lubricating composition is from about 1,000 parts per million to 20,000 parts per million (i.e. 0.1 to 2.0 wt %) based on the total weight of the lubricating oil composition, preferably the concentration is from 1,000 to 10,000 parts per million (ppm) and more preferably from about 2,000 to 8,000 ppm by weight. Quantities of less than 1,000 ppm have little or minimal effectiveness whereas quantities larger than 10,000 ppm are generally not economical.

As used herein and in the claims the term "phenate" means the broad class of metal phenates including salts of alkylphenols, alkylphenol sulfides, and the alkylphenol-aldehyde condensation products. Detergents formed from the polar phenate substrate may be overbased. Normal phenate has the structural formula:

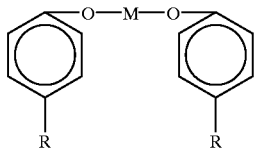

whereas methylene coupled phenate has the structural formula:

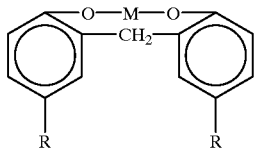

and phenate sulfide has the formula:

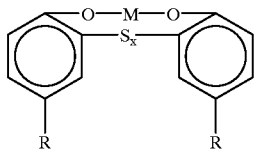

wherein R is an alkyl group preferably of eight or more carbon atoms, M is a metallic element (e.g. Ca, Ba, Mg), and x can range from 1 to 3 depending on the particular metal involved. The calcium and magnesium phenates are preferred for use in the three-component system of the present invention.

The materials are generally prepared by carrying out the reaction in a low viscosity mineral oil at temperatures ranging up to 260° C. depending on the reactivity of the metallic base. The alkylphenol intermediates can be prepared by alkylating phenol with olefins, chlorinated paraffins, or alcohols using catalysts such as $H_2SO_4$ and $AlCl_3$, with the latter being employed with the chlorinated paraffin in a typical Friedel-Crafts type of alkylation.

By use of an excess of the metal base over the theoretical amounts required to form the normal phenates, it is possible to form the so-called basic phenates. Basic alkaline-earth phenates containing two and three times the stoichiometric quantity of metal have been reported in the patent literature.

Since an important function of the alkaline-earth metal phenate is acid neutralization, the incorporation of excess base into these materials provides a distinct advantage over the metal-free phenates. Basic phenates can also be prepared from the phenol sulfides. This imparts the benefits of acid neutralization capacity to the phenol sulfides.

Overbased alkaline-earth metal phenates have been casually defined by the amount of total basicity contained in the product. It has become popular to label a detergent by its TBN (total base number), i.e. a 300 TBN synthetic sulfonate. Base number is defined in terms of the equivalent amount of potassium hydroxide contained in the material. A 300 TBN calcium sulfonate contains base equivalent to 300 milligrams of potassium hydroxide per gram or, more simply, 300 mg KOH/g. Two factors limit the degree of overbasing: oil solubility and filterability.

The alkaline-earth metal phenates useful in the present invention should have TBN's of from about 40 to 350 with 100–250 being more preferred and 120–200 being most preferred. Representative of the commercially available high TBN phenates which are useful in the present invention include: Oloa™ 216S (5.25% calcium, 3.4% sulfur, 145 TBN); Oloa™ 218A (5.25% calcium, 2.4% sulfur, 147 TBN); Oloa™ 219 (9.25% calcium, 3.3% sulfur, 250 TBN); and Oloa™ 247E (12.5% calcium, 2.4% sulfur, 320 TBN). All of these calcium phenates are available from the Chevron Chemical Company, Oronite Additives Division, Richmond, Calif. Other representative commercially available calcium phenates include Lubrizol™ 6499 (9.2% calcium, 3.25% sulfur, 250 TBN); Lubrizol™ 6500 (7.2% calcium, 2.6% sulfur, 200 TBN); and Lubrizol™ 6501 (6.8% calcium, 2.3% sulfur, 190 TBN). All of these phenates are available from the Lubrizol Corporation of Wickliffe, Ohio. TBN's may be determined using ASTM D 2896.

Although the alkaline-earth metal phenates useful in the present invention fall into the general class of additives known as detergents, the phenates are not interchangeable with other detergents, i.e. sulfonates, as two detergents having the same TBN, molecular weight, metal ratio and the like, will have widely different performance characteristics in the present invention.

Preferably, the quantity of molybdenum in relation to the quantity of the diarylamine should be within a certain ratio. The quantity of molybdenum should be about 0.0025 to 1.0 parts by weight for each part by weight of the diarylamine in the lubricating oil composition. Preferably, this ratio will be from about 0.005 to 0.5 parts of the molybdenum from the molybdenum compound per part of the diarylamine and more preferably about 0.005 to 0.25 parts of the molybdenum from the molybdenum compound per part of the diarylamine. The total quantity of molybdenum from the molybdenum compound and diarylamine can be provided by one or more than one molybdenum or diarylamine compound. The weight ratio of the molybdenum from the molybdenum compound to the alkaline-earth metal phenate will typically be about 0.00125 to 0.5 parts of molybdenum per part of alkaline-earth metal phenate with 0.00125 to 0.25 being more preferred and 0.00125 to 0.125 being most preferred.

The composition of the lubricant oil can vary significantly based on the customer and specific application. The oil may contain, in addition to the three-component system according to the invention, a detergent/inhibitor additive package and a viscosity index improver. In general, the lubricant oil is a formulated oil which is composed of between 75 and 95 weight percent (wt. %) of a base oil of lubricating viscosity, between 0 and 10 wt. % of a polymeric viscosity index improver, between 0.3 and about 5.0 wt. % of the inventive three part system and between about 5 and 15 wt. % of an additional additive package.

The detergent/inhibitor additive package may include dispersants, detergents, zinc dihydrocarbyl dithiophosphates (ZDDP), additional antioxidants, pour point depressants, corrosion inhibitors, rust inhibitors, foam inhibitors and supplemental friction modifiers.

The dispersants are nonmetallic additives containing nitrogen or oxygen polar groups attached to a high molecular weight hydrocarbon chain. The hydrocarbon chain provides solubility in the hydrocarbon base stocks. The dispersant functions to keep oil degradation products suspended in the oil. Examples of commonly used dispersants include copolymers such as polymethacrylates and styrene-maleic ester copolymers, substituted succinimides, polyamine succinimides, polyhydroxy succinic esters, substituted Mannich bases, and substituted triazoles. Generally, the dispersant is present in the finished oil between 0 and 10 wt. %.

The detergents are metallic additives containing charged polar groups, such as sulfonates or carboxylates, with aliphatic, cycloaliphatic, or alkylaromatic chains, and several metal ions. The detergents function by lifting deposits from the various surfaces of the engine. Examples of commonly used detergents include neutral and overbased alkali and alkaline earth metal sulfonates, overbased alkaline earth salicylates, phosphonates, thiopyrophosphonates, and thiophosphonates. Generally, when used, the detergents are present in the finished oil between about 0.5 and 5.0 wt. %.

The ZDDP's are the most commonly used antiwear additives in formulated lubricants. These additives function by reacting with the metal surface to form a new surface active compound which itself is deformed and thus protects the original engine surface. Other examples of anti-wear additives include tricresol phosphate, dilauryl phosphate, sulfurized terpenes and sulfurized fats. The ZDDP also functions as an antioxidant. Generally, the ZDDP is present in the finished oil between about 0.25 and 1.5 wt. %. It is desirable from environmental concerns to have lower levels of ZDDP. Phosphorus-free oils contain no ZDDP.

Additional antioxidants, other than the diarylamine, may be used. The amount of supplemental antioxidant will vary depending on the oxidative stability of the base stock. Typical treat levels in finished oils can vary from 0 to 2.5 wt %. The supplementary antioxidants that are generally used include hindered phenols, hindered bisphenols, sulfurized phenols, sulfurized olefins, alkyl sulfides and polysulfides, dialkyl dithiocarbamates, and phenothiazines. The inclusion of molybdenum compounds with diphenylamines and alkaline-earth metal phenates generally removes the need for these supplementary antioxidants. However, a supplementary antioxidant may be included in oils that are less oxidatively stable or in oils that are subjected to unusually severe conditions.

The base oil according to the present invention may be selected from any of the synthetic or natural oils or mixtures thereof. These oils are typical crankcase lubrication oils for spark-ignited and compression-ignited internal combustion engines, for example NG engines, automobile and truck engines, marine, and railroad diesel engines. The synthetic base oils include alkyl esters of dicarboxylic acids, polyglycols and alcohols, poly-alpha-olefins, including polybutenes, alkyl benzenes, organic esters of phosphoric acids, and polysilicone oils. Natural base oils include mineral lubrication oils which may vary widely as to their crude source, e.g., as to whether they are paraffinic, naphthenic, or mixed paraffinic-naphthenic. The base oil typically has a viscosity of about 2.5 to about 15 cSt and preferably about 2.5 to about 11 cSt at 100° C.

The lubricating oil compositions of this invention can be made by adding the molybdenum compound, the alkaline-earth metal phenate and the diarylamine to an oil of lubricating viscosity. The method or order of component addition is not critical. Alternatively, the combination of molybdenum, alkaline-earth metal phenate and diarylamine can be added to the oil as a concentrate.

The lubricating oil concentrate will comprise a solvent and from about 2.5 to 90 wt. % and preferably 5 to 75 wt. % of the combination of the molybdenum compound, the alkaline-earth metal phenate and diarylamine of this invention. Preferably the concentrate comprises at least 25 wt. % of the three-component system and most preferably at least 50 wt. %. The solvent for the concentrate may be a mineral or synthetic oil or a hydrocarbon solvent. The ratio of molybdenum to amine in the concentrate composition is from about 0.0025 to 1 part of molybdenum from the molybdenum compound per part of diarylamine and preferably from about 0.005 to 0.5, more preferably 0.005 to 0.25, parts of molybdenum for each part of the diarylamine by weight. The ratio of molybdenum to alkaline-earth metal phenate in the concentrate composition is from about 0.00125 to about 0.5 molybdenum from the molybdenum compound per part of alkaline-earth metal phenate.

There are a number of recent trends in the petroleum additive industry that may restrict, and/or limit, the use of certain additives in formulated crankcase oils. These trends include a move to lower phosphorus levels in the oil, improved fuel economy, and more severe engine environments. Such changes may show that certain currently used antioxidant additives are no longer effective in protecting the oil against oxidation and deposit formation. The molybdenum/diarylamine/alkaline-earth metal phenate based additive mixture disclosed herein provides a solution to this need. Furthermore, there is concern that phosphorus from the lubricant tends to poison the catalyst used in catalytic converters, thereby preventing the catalytic converters from functioning to full effect. Also, active sulfur-containing antioxidants, including active sulfur containing molybdenum compounds are known to cause copper corrosion and are not compatible with elastomer seals used in modern engines. This is generally known and has been disclosed by T. Colclough in Atmospheric Oxidation and Antioxidants, Volume II, chapter 1, Lubrication Oil Oxidation and Stabilization, G. Scott, editor, 1993 Elsevier Science Publishers.

The molybdenum compound in this invention is preferably substantially free of phosphorus and is substantially free of reactive sulfur and it is particularly preferred to have the molybdenum compound substantially free of sulfur whether active or otherwise.

The following examples are illustrative of the invention and its advantageous properties and are not intended to be limiting. In these examples as well as elsewhere in this application, all parts and percentages are by weight unless otherwise indicated.

EXAMPLE 1

To test the three-component system of this invention in various forms, the oils set forth in Table 1 were prepared. The pre-blend oil was a current passenger car motor oil formulation used in 5W-30 passenger car motor oils. Pre-blend Oils #1 through #14 contained 0.3 wt. % diphenylamine. Pre-blend Oils #15 and #16 did not contain diphenylamine. The basestock oil consisted of a blend of Excel™ 100N hydrocracked and Excel™ 260N hydrocracked. The molybdenum containing compound was an organomolybdenum complex of organic amide marketed by the R.T. Vanderbilt Company, Inc. of Norwalk, CT under the tradename Molyvan™ 855. This compound contains 8 percent by weight of molybdenum. Process oil without any additives was used to make the test oil come up to 100%. The diphenylamine compound was a styryloctyl diphenylamine obtained from Ethyl Corporation. The calcium sulfonate low TBN had a TBN of 27.5 and was obtained from Ethyl Corporation. The calcium sulfonate high TBN had a TBN of 300 and was obtained from Ethyl Corporation. The magnesium sulfonate had a TBN of 400 and was obtained from Ethyl Corporation. The calcium phenate had a TBN of 250 and was obtained from the Lubrizol Corporation. The overbased sodium sulfonate had a TBN of 400 and was obtained from the Lubrizol Corporation. Copper naphthenate contained 8% copper by weight and was obtained from the OM Group.

TABLE 1

Test Oil Blends
(All Values Are Weight Percent)

| Component | Oil #1 | Oil #2 | Oil #3 | Oil #4 | Oil #5 | Oil #6 | Oil #7 | Oil #8* | Oil #9 | Oil #10* | Oil #11 | Oil #12 | Oil #13 | Oil #14 | Oil #15 | Oil #16 |
|---|---|---|---|---|---|---|---|---|---|---|---|---|---|---|---|---|
| Pre-blend Oil | 97 | 97 | 97 | 97 | 97 | 97 | 97 | 97 | 97 | 97 | 97 | 97 | 97 | 97 | 97 | 97 |
| Diphenylamine in Pre-blend Oil | 0.3 | 0.3 | 0.3 | 0.3 | 0.3 | 0.3 | 0.3 | 0.3 | 0.3 | 0.3 | 0.3 | 0.3 | 0.3 | 0.3 | 0 | 0 |
| Calcium Sulfonate - Low TBN | 0.9 | 0.5 | 0.5 | 0 | 0.4 | 0.9 | 1.4 | 0.5 | 1.0 | 0.7 | 0.9 | 1.0 | 0.5 | 0.5 | 0.5 | 0.7 |
| Calcium Sulfonate - High TBN | 0.6 | 0.9 | 1.0 | 1.7 | 1.7 | 0.6 | 0.6 | 1.0 | 1.0 | 1.4 | 0.6 | 0.3 | 1.0 | 0.9 | 1.0 | 1.4 |
| Magnesium Sulfonate | 0.9 | 1.2 | 0 | 0 | 0 | 0.9 | 0.9 | 0 | 0 | 0 | 0.9 | 0.9 | 0 | 0 | 0 | 0 |
| Calcium Phenate | 0 | 0 | 1.0 | 1.0 | 0.5 | 0 | 0 | 1.0 | 1.0 | 0.5 | 0 | 0 | 1.0 | 1.0 | 1.0 | 0.5 |
| Overbased Sodium Sulfonate | 0 | 0 | 0 | 0 | 0 | 0 | 0 | 0 | 0 | 0 | 0 | 0.2 | 0 | 0.2 | 0 | 0 |
| Copper Naphthenate | 0 | 0 | 0 | 0 | 0 | 0 | 0 | 0 | 0 | 0 | 0.25 | 0 | 0.25 | 0 | 0 | 0 |
| Molybdenum Cpd. | 0 | 0 | 0 | 0 | 0 | 0.25 | 0 | 0.25 | 0 | 0.125 | 0 | 0 | 0 | 0 | 0.25 | 0.125 |
| Process Oil | 0.6 | 0.4 | 0.5 | 0.3 | 0.4 | 0.35 | 0.10 | 0.25 | 0 | 0.28 | 0.35 | 0.6 | 0.2 | 0.6 | 0.25 | 0.28 |

* = Invention

The test oils were then evaluated by pressurized differential scanning calorimetry (PDSC) to evaluate their oxidation stability. The PDSC procedure used is described by J. A. Walker and W. Tsang in "Characterization of Lubrication Oils by Differential Scanning Calorimetry", SAE Technical Paper Series, 801383 (Oct. 20–23, 1980). Oil samples were treated with an iron naphthenate catalyst (50 ppm Fe) and approximately 2 milligrams were analyzed in an open aluminum hermetic pan. The DSC cell was pressurized with 400 psi of air containing approximately 55 ppm $NO_2$ as an oxidation catalyst. The following heating sequence was used: Ramp 20° C./min to 120° C., Ramp 10° C./min to 150° C., Ramp 2.5° C. to 250° C., Isothermal for 1 minute. During the temperature ramping sequence an exothermic release of heat is observed. This exothermic release of heat marks the oxidation reaction. The temperature at which the exothermic release of heat is observed is called the oxidation onset temperature and is a measure of the oxidative stability of the oil (i.e., the higher the oxidation onset temperature the greater the oxidative stability of the oil). All oils were evaluated in triplicate or quadruplicate and the results averaged. The results are set forth in Table 2.

TABLE 2

PDSC Testing

| On Set Temp ° C. | Oil #1 | Oil #2 | Oil #3 | Oil #4 | Oil #5 | Oil #6 | Oil #7 | Oil #8* | Oil #9 | Oil #10* | Oil #11 | Oil #12 | Oil #13 | Oil #14 | Oil #15 | Oil #16 |
|---|---|---|---|---|---|---|---|---|---|---|---|---|---|---|---|---|
| #1 | 204.7 | 205.6 | 211.7 | 209.2 | 208.9 | 214.2 | 206.1 | 219.3 | 211.9 | 214.9 | 209.8 | 206.9 | 212.7 | 214.3 | 200.3 | 196.0 |
| #2 | 207.3 | 206.7 | 211.4 | 212.1 | 208.2 | 213.9 | 205.4 | 218.8 | 211.2 | 216.0 | 209.0 | 206.4 | 211.4 | 212.2 | 200.3 | 196.6 |
| #3 | 205.0 | 206.1 | 211.5 | 211.5 | 206.8 | 214.0 | 205.6 | 218.2 | 212.2 | 212.4 | 209.7 | 207.0 | 211.3 | 209.3 | 197.9 | 195.4 |
| #4 | 204.3 | — | — | 212.0 | — | — | — | — | — | 211.6 | — | — | 211.3 | 211.1 | — | — |
| Avg. | 205.3 | 206.1 | 211.5 | 211.2 | 208.0 | 214.0 | 205.7 | 218.8 | 211.8 | 213.7 | 209.5 | 206.8 | 211.7 | 211.7 | 199.5 | 196.0 |

* = Invention

The onset temperature results in Table 2 clearly show the advantage of the three-component system according to the invention (Oils #8 and #10) in controlling oxidation in fully formulated passenger car motor oils. Note that for test oils containing only one or two components of the system, there is an analogous three-component entry that achieves equivalent or better results, i.e., equivalent or higher onset temperatures, with less additives. For example, Oil #8 can achieve an onset temperature of 218.8 compared to Oil #9 at 211.8 which contains only two components (the diphenylamine and the calcium phenate). Oil #10 which contains one half the level of molybdenum of Oil #6 (no phenate) achieved almost the same onset temperature as Oil #6. This is supportive of synergistic activity between the molybdenum compound and the calcium phenate. This type of response is seen consistently when comparing oils containing only one or two components with oils containing all three-components. Further evidence of synergistic activity between the molybdenum compound and the diarylamine is seen in Oils #15 and #16 where deletion of the diarylamine drops the average onset temperature more than 20° C. when compared to Oil #8.

The oils were also evaluated using the Caterpillar Modified Micro-Oxidation Test (CMOT). The CMOT is a commonly-used technique for evaluating the deposit forming tendencies of a wide variety of passenger car and diesel lubricants as well as mineral and synthetic basestocks. The test measures the oxidative stability and deposit forming tendencies of lubricants under high temperature thin-film oxidation conditions. The ability to easily vary test conditions and the flexibility of presenting test results makes it a valuable research tool for screening a wide variety of lubricant products.

A thin-film of oil is weighed and placed in a weighed indented low carbon steel sample holder immersed in a test tube that is placed in a high temperature bath. Dry air is passed, at a specific rate, through the test tube, over the oil sample, and out of the test tube to the atmosphere. At specific time intervals the carbon steel sample holders are removed from the high temperature bath, rinsed with solvent to remove any remaining oil, and oven dried. The sample holders are weighed to determine the amount of deposit formed at the sampling interval. The method requires sampling at a variety of time intervals and determining percent deposits at each time interval. The CMOT tests were run using a temperature of 220° C., an air flow of 20 cc/min and sampling times of 90, 120, 150 and 180 minutes.

The results of the CMOT are set forth in Table 3.

TABLE 3

| | CMOT Results % Deposits | | | | | | | | | | | | | | | |
|---|---|---|---|---|---|---|---|---|---|---|---|---|---|---|---|---|
| Time Mins. | Oil #1 | Oil #2 | Oil #3 | Oil #4 | Oil #5 | Oil #6 | Oil #7 | Oil #8*+ | Oil #9+ | Oil #10* | Oil #11 | Oil #12 | Oil #13 | Oil #14 | Oil #15 | Oil #16 |
| 90 | 17.9 | 16.7 | 2.2 | 3.8 | 1.6 | 0.4 | 12.7 | 0.7<br>0.4 | 0.9<br>1.4 | 0.3 | 3.4 | 15.1 | 1.2 | 5.7 | 9.9 | 5.5 |
| 120 | 19.3 | 21.4 | 12.9 | 16.3 | 9.8 | 4.7 | 16.6 | 0.6<br>1.3 | 4.3<br>2.9 | 0.9 | 4.0 | 17.0 | 8.1 | 12.3 | 11.7 | 15.7 |
| 150 | 19 | 21.6 | 13.2 | 15.9 | 15.6 | 3.9 | 16.3 | 1.1<br>0.9 | 8.9<br>6.8 | 1.0 | 15.4 | 20.0 | 11.3 | 18.4 | 13.8 | 18.1 |
| 180 | 19 | 21.2 | 12.3 | 16.4 | 13.4 | 6.7 | 18.5 | 2.0<br>1.1 | 11.8<br>11.3 | 3.9 | 12.4 | 18.8 | 11.6 | 15.2 | 16.8 | 17.0 |

* = Invention
+ = Two tests per oil

The results presented in Table 3 clearly indicate that the three-component additive system according to the invention (Oils #8 and #10) provides superior deposit control in the CMOT. At constant TBN and active detergent level, the three-component additive combination of the invention is more effective than phenate/diphenylamine (Oils #3, #13 and #14); molybdenum/diphenylamine (Oil #6) and phenate/molybdenum (Oils #15 and #16).

EXAMPLE 2

This experiment was conducted to evaluate the three-component additive system of the invention against a diphenylamine/calcium phenate additive system in the CMOT and the Caterpillar 1M-PC engine. The 1M-PC test method is designed to relate to high speed, supercharged diesel engine operation, and, in particular, to the detergency characteristics and anti-wear properties of diesel crankcase lubricating oils. This test uses a single-cylinder supercharged diesel engine to evaluate ring sticking, ring and cylinder wear and piston deposits. Prior to each test run, the power section of the engine (excluding piston assembly) was completely disassembled, solvent cleaned, measured, and rebuilt in strict accordance with furnished specifications. A new piston, piston ring assembly and cylinder liner were installed prior to each test. The engine crankcase was solvent cleaned and worn or defective parts were replaced. The test stand was equipped with appropriate accessories for controlling speed, fuel, rate, and various engine-operating conditions. A suitable system for supercharging the engine with humidified and heated air was also provided. Test operation involves the control of the supercharged, single-cylinder diesel test engine for a total of 120 hours at a fixed speed and fuel rate using the test oil as a lubricant. A one-hour engine break-in preceded each test. At the conclusion of the test, the piston, rings, and cylinder liner were examined. The degree of cylinder liner and piston ring wear was noted and the amount and nature of piston deposits present was also recorded. Evaluation was also made to determine if any rings were stuck. In a manner similar to that described in Example 1, two natural gas engine oil candidates were prepared. Oils #17 and #18 consisted of a base oil blend with a standard additive package for HDD oil excluding any diphenylamine, phenate and molybdenum compound.

To prepare Oil #17 the base oil had added to it 0.676 wt % diphenylamine and 0.756 wt % of calcium phenate. Oil #18 contained 0.61 wt % diphenylamine, 0.58 wt % calcium phenate and 0167 wt % of a sulfur and phosphorus-free organomolybdenum complex of organic amide (Molyvan™ 855). Details on Oils #17 and #18 can be found in Table 5. The results from the CMOT and the 1M-PC testing are set forth in Table 4.

TABLE 4

| CMOT and 1M-PC Testing | | |
|---|---|---|
| Test CMOT- Time Minutes | Oil #17 | Oil #18* |
| 90 | 2.1 | 1.8 |
| 120 | 2.1 | 1.7 |
| 150 | 2.9 | 1.7 |
| 180 | 16.5 | 2.0 |
| 1M-PC Deposit Rating | 300.3 | 156.6 |

* = Invention

As seen in Table 4, Oil #17 shows a very high level of deposit formation in the CMOT at the 180 minute sampling period. In contrast Oil #18, in accordance with the invention, shows excellent CMOT results at the 180 minute sampling period. The passing limit for deposits in the 1M-PC is 240 Weighted Total Deposits (WTD) maximum. Thus, Oil #17 is a failing oil while Oil #18 is a strong passing oil. This experiment also evidences that the CMOT, at the 180 minute sampling period, has strong correlation to the 1M-PC test, and thus the CMOT is a good bench test for the prediction of deposit formation in the 1M-PC test.

EXAMPLE 3

This experiment was conducted to further characterize the inventive three-component additive package against additive packages outside the scope of the present invention using the 1M-PC test. Table 5 sets forth the composition of Oils #17 and #18 that were used in Example 2, and Oils #19 and #20 used in this Example.

TABLE 5

Test Oil Compositions (% By Weight)

| Component | Oil #17 | Oil #18* | Oil #19* | Oil #20 |
|---|---|---|---|---|
| Dispersants | 3.57 | 3.76 | 3.76 | 4.18 |
| Detergent | 0.743 | 0.89 | 0.89 | 1.06 |
| Antiwear | 0.588 | 0.7 | 0.7 | 0.65 |
| Antioxidants (excluding diarylamine) | 0.336 | 0.45 | 0.45 | 0.42 |
| Demulsifier, silicone, antirust, diluent | 0.341 | 0.343 | 0.39 | 0.31 |
| VI Improver/PPD | 11.0 | 9.1 | 9.1 | 7.79 |
| Base Oil | 81.99 | 83.4 | 83.4 | 84.5 |
| Calcium Phenate | 0.756 | 0.58 | 0.58 | 0.44 |
| Diarylamine | 0.676 | 0.61 | 0.61 | 0.65 |
| Molybdenum Molyoctanoate | — | — | 0.12 | — |
| Molyvan ™ 855 | — | 0.167 | — | — |

* = Invention

The 1M-PC test as described in Example 2 was used to test Oils #17–20. The results are presented in Table 6.

TABLE 6

1M-PC Test Results

| 1M-PC Test Parameter | Oil #17 | Oil #18* | Oil #19* | Oil #20 |
|---|---|---|---|---|
| Top Groove Fill, % | 60 | 35 | 56 | 13 |
| WTD | 300.3 | 156.6 | 239 | 272.5 |
| Ring Side Clearance Loss, mm | 0.013 | 0 | 0 | 0 |
| Pass/Fail | Fail | Pass | Pass | Fail |

* = Invention

The data in Table 6 clearly support the innovative three-component additive system (Oils #18 and #19) as being highly effective in reducing the amount of deposit formation. Oil #18 was also evaluated in the Cummins 8.3 L Natural Gas Engine. The Cummins Natural Gas Engine Test utilizes a turbocharged, in-line 6 cylinder, overhead valve configuration with 8.3 L displacement. This design is representative of many modern NG engines. The engine features electronic control of air/fuel ratio and spark timing. This test is designed to evaluate oil performance in terms of tappet wear, viscosity increase and piston, ring and valve deposits in a NG engine. After set up of the engine, the engine was operated for a total of 200 hours at 110% of rated fueling, 275 hp at 2400 rmp (conditions deliberately selected to accelerate wear and deposit formation). The oil's performance was determined by disassembling the engine and measuring the wear, and piston, ring and valve deposits. Details of this test and reported ranges of acceptable performance (if reported) can be found in SAE Paper 981370. The results of this test and reported acceptable ranges are found in Table 7.

TABLE 7

Cummins Natural Gas Engine Test

| Test Parameter | Oil #18 | Acceptable Range |
|---|---|---|
| Avg. Tappet Face Wear (Height), micrometers | 6.88 | 4–8 |
| Avg. Tappet Weight Loss, grams | −0.025 | Usually negative |

TABLE 7-continued

Cummins Natural Gas Engine Test

| Test Parameter | Oil #18 | Acceptable Range |
|---|---|---|
| Avg. Ball Socket Wear, micrometers | 6.67 | Not A Good Discriminator |
| Average Liner Wear, micrometers | 2.49 | 1–2.6 |
| Average Top Piston Ring Wear, mg | 7.7 | Not Reported |
| Average Second Piston Ring Wear, mg | 38.2 | Not Reported |
| Avg. Connecting Rod Bearing Wt. Loss, mg | 1.8 | 4–17 |
| Unweighted Piston Deposit Rating, demerit | 89.6 | 70–120 |
| Avg. Intake/Exhaust Valve Deposit Rating, demerit | 9.3 | 8.4–9.7 Depending on Valve Stem Seals |
| Avg. Exhaust Valve Recession, micrometers | 60 | 5–350 Depending on Valve Stem Seals |
| Viscosity Increase, KV at 100° C. | −7.26% | About 4% Increase |
| Used Oil Pb at EOT, ppm | 3 | 0–5 |
| Used Oil Fe at EOT, ppm | 10 | 8–9 |
| Used Oil Cu at EOT, ppm | 32 | Possible Heat Exch. Passivation |
| TBN Drop by D4739 | 1.55 | Most Oils Dropped 3 Units |
| TAN Increase by D664-87 | 0.45 | Most Oils Increased About 1 Unit |

As demonstrated by this test the lubricating oils according to the invention provide very acceptable performance in the NG engine. Oil #18 was also evaluated in the L-38 test. The L-38 test is used for determining crankcase lubricating oil characteristics under high temperature operation conditions. The characteristics evaluated include: auto-oxidation, corrosive tendency, sludge and varnish producing tendencies, and viscosity stability. The engine used in the test is a single cylinder, liquid cooled, spark-ignition engine operated at a fixed speed and fuel flow. The engine is operated at 3150 rpm for 40 hrs. The test is stopped every 10 hours for oil sampling and the viscosity of these samples is determined. A special copper-lead test bearing is weighed before and after the test to determine the weight loss due to corrosion. Details on the L-38 procedure are set forth in ASTM D 5119. Table 8 sets forth the results of the L-38 on Oil #18.

TABLE 8

L-38 Testing

| Test Parameter | Value for Oil #18 | Allowed Limits |
|---|---|---|
| Bearing Weight Loss | 15.6 mg | 40 mgs Max. |
| New Oil Viscosity | 14.09 | |
| Viscosity at 10 hour | 13.05 | Stay in Grade |
| 20 hour | 12.70 | Stay in Grade |
| 30 hour | 12.72 | Stay in Grade |
| 40 hour | 12.62 | Stay in Grade |
| Pass/Fail | Pass | |

This testing procedure also demonstrates that a lubricating oil containing the inventive three-component additive package provides outstanding properties to the lubricating oil.

EXAMPLE 4

Four additional oils were prepared similar to those described in Table 5, except the levels of non-diarylamine antioxidant, diarylamine, calcium phenate and molybdenum compound were as set forth in Table 9.

TABLE 9

| Components in % By Weight | | | | |
|---|---|---|---|---|
| Component | Oil #21 | Oil #22* | Oil #23 | Oil #24* |
| Calcium phenate | 2.3 | 2.3 | 2.3 | 2.3 |
| Non-diarylamine antioxidant | 0.8 | 0.8 | 0.5 | 0.5 |
| Diarylamine | 0.4 | 0.4 | 0.4 | 0.4 |
| Molyvan ™ 855 | — | 0.167 | — | 0.167 |

* = Invention

Oils #21–24 were subjected to the Panel Coker Test. The Panel Coker Test is a procedure for determining the tendency of oils to form solid decomposition products when in contact with surfaces at elevated temperatures. The test used a Falex Panel Coking Test Apparatus. The Falex apparatus is designed to perform Federal Test Standard 791 B, Method 3462. The results for this test are set forth in Table 10.

TABLE 10

| Panel Coker Test | | | | |
|---|---|---|---|---|
| Parameter | Oil #21 | Oil #22* | Oil #23 | Oil #24* |
| Panel Deposit (mg) | 247 | 55 | 533 | 319 |

* = Invention

The inventive Oils #22 and #24 significantly outperformed the control Oils #21 and #23 which were respectively identical except that the controls contained no molybdenum compound. This test also supports the inventor's findings that the three-component additive package exhibits synergistic activity in protecting a lubricating oil from thermal and oxidative degradation. From the results of all testing presented above, it is quite apparent that the inventive oil additive package would be highly effective in a passenger car motor oil, a heavy duty engine oil as well as a NG engine oil.

EXAMPLE 5

A lubrication formulation in accordance with this invention, Oil #18, was tested in the ASTM Sequence IIIE engine test. The IIIE test uses a 231 CID (3.8 liter) Buick V-6 engine which is operated on leaded fuel at high speed (3,000 rpm) and a very high oil temperature of 149° C. for 64 hours. This test is used to evaluate an engine oil's ability to minimize oxidation, thickening, sludge, varnish, deposits, and wear. This test provides improved discrimination with respect to high temperature camshaft and lifter wear protection and oil thickening control.

TABLE 11

| Sequence IIIE Evaluation | | |
|---|---|---|
| Test Parameter | Oil #18 | Acceptable Limits |
| Hours to 375% Vis. Increase | 70.8 | 64 min. |
| Average Sludge | 9.49 | 9.2 min. |
| Average Varnish | 8.78 | 8.9 min. |
| Ring Land Face Varnish | 5.19 | 3.5 min. |
| Cam and Lifter Wear, Av., microns | 17.2 | 30 max. |
| Cam and Lifter Wear, Max. microns | 38 | 64 max. |
| Pass/Fail | Pass on Wear | |

The results presented in Table 11 clearly show that the molybdenum/diphenylamine/phenate combination is very effective at both controlling viscosity and reducing engine wear.

EXAMPLE 6

Oil compositions according to the invention and control oils were also evaluated in the Caterpillar 1P Test (1P). The 1P test uses a single-cylinder test engine that has a two-piece piston with forged steel crown and aluminum skirts. The test is designed to evaluate valve train wear, piston ring and liner wear, bearing wear, filter life, sludge, piston deposits and oil consumption. This test is designed to simulate high operating temperatures and high levels of soot in the crankcase. Details on the Caterpillar 1P Test can be found in SAE Technical Paper No. 981371 (May 1998). Three oils were formulated as set forth in Table 12.

TABLE 12

| Test Oil Compositions (% By Weight) | | | |
|---|---|---|---|
| | Oil #25 | Oil #26 | Oil #27* |
| Dispersants | 9.6 | 9.6 | 9.583 |
| Detergents | 0.66 | 1.06 | 0.659 |
| Antiwear | 1.45 | 1.45 | 1.447 |
| Supplemental Antioxidants | 0.8 | 0.8 | 0.799 |
| Silicone/Diluent | 0.59 | 0.59 | 0.591 |
| VI Improver/PPD | 6.15 | 6.15 | 6.139 |
| Base Oils | | | |
| Mineral | 56.05 | 55.55 | 55.957 |
| Poly-alpha Olefin | 22 | 22 | 21.963 |
| Calcium Phenate | 2.3 | 2.3 | 2.296 |
| Diarylamine | 0.4 | 0.5 | 0.399 |
| Molybdenum | | | |
| Molyvan ™ 855 | — | — | 0.167 |

* = Invention

The oils were evaluated in the 1P test and the results are set forth in Table 13

TABLE 13

| Caterpillar 1P Test Results | | | | | | |
|---|---|---|---|---|---|---|
| 1P Test Parameter | Oil #25 Test #1 | Oil #25 Test #2 | Oil #25 Test #3 | Oil #26 | Oil #27* | Limits |
| Total Weighted Deposit | 390.6 | — | — | 384.8 | 268.3 | 350 max |
| Top Groove Carbon | 29.75 | — | — | 60.00 | 25.25 | 36 max |
| Top Land Carbon | 69.25 | — | — | 48.00 | 28 | 40 max |
| Average Oil Consumption, g/h (0–360 h) | 10.0 | — | — | 14.1 | 7.5 | 12.4 max |
| Final Oil consumption, g/h (312–360 h) | 19.4 | — | — | 39.5 | 7.9 | 14.6 max |
| Scuffing, Piston, Ring, Liner | None | — | — | None | None | None |

TABLE 13-continued

| | Caterpillar 1P Test Results | | | | | |
|---|---|---|---|---|---|---|
| 1P Test Parameter | Oil #25 Test #1 | Oil #25 Test #2 | Oil #25 Test #3 | Oil #26 | Oil #27* | Limits |
| Comments | Fail | Abort Due to Excessively High Oil Consumption. | Abort Due to Excessively High Oil Consumption | Fail | Pass | |

* - Invention

Oils #25 and #26 were essentially identical to Oil #27 except that Oil #27 contained 0.167 percent molybdenum compound. This small addition of the molybdenum compound (Molyvan 855) had a dramatic impact on the performance characteristics of the oil in the IP test. Oil consumption and deposits were drastically reduced in the oil according to this invention. These data support the presence of synergistic activity in the three-component system according to this invention.

The inventors have identified a three-component additive package that addresses the shortcomings of the prior art lubricant additive packages. The present invention will be of substantial benefit to engine manufacturers, lubricating oil companies and the motoring public that is interested in reduced levels of pollution and extended engine life.

Although the invention has been described in connection with certain specific embodiments, it will be readily apparent to those skilled in the art that various changes can be made to suit specific requirements without departing from the spirit and scope of the invention.

What is claimed is:

1. A lubricating composition comprising a major amount of lubricating oil, an oil-soluble molybdenum compound substantially free of reactive sulfur, an oil-soluble diarylamine and a calcium phenate wherein said molybdenum compound is present in the lubricating composition in an amount sufficient to provide from 50 to 1000 ppm of molybdenum to the lubricating composition.

2. The lubricating composition according to claim 1 wherein said oil-soluble molybdenum compound is selected from the group consisting of: glycol molybdate complexes; overbased alkali metal and alkaline earth metal sulfonates, phenates and salicylate compositions containing molybdenum; molybdenum complexes prepared by reacting a fatty oil, a diethanolamine and a molybdenum source; an organomolybdenum complex of organic amide; molybdenum containing compounds prepared from fatty acids and 2-(2-aminoethyl)aminoethanol; molybdenum containing compounds prepared from 1-(2-hydroxyethyl)-2-imidazoline substituted by a fatty residue derived from fatty oil or a fatty acid; molybdenum complexes prepared from amines, diamines, alkoxylated amines, glycols and polyols; 2,4-heteroatom substituted-molybdena-3,3-dioxacycloalkanes; molybdenum carboxylates and mixtures thereof.

3. The composition of claim 1 wherein said molybdenum compound is an organomolybdenum complex of organic amide.

4. The composition of claim 1 wherein said diarylamine is selected from the group consisting of: octylstyryl alkylated diphenylamine, nonylalkylated diphenylamines, butyloctylalkylated diphenylamine, $C_4$ to $C_{12}$ alkylated diphenylamne and mixtures thereof.

5. The composition of claim 1 wherein said diarylamine is an alkylated diphenylamine, wherein at least one of said aryl groups is alkaryl having from 4 to 30 carbon atoms.

6. The composition of claim 1 wherein said diarylamine is present in an amount of from 1,000 to 20,000 ppm.

7. The composition of claim 1 wherein said phenate is present in an amount of from 2,000 to 40,000 ppm.

8. The composition of claim 2 wherein the aryl groups of said diarylamine are selected from the group consisting of phenyl, naphthyl, alkphenyl wherein the alkyl portion has from about 4 to 18 carbon atoms and alknaphthyl wherein the alkyl portion has about 4 to 18 carbon atoms; and the amount of said diarylamine in the lubricating composition is from about 1,000 to 20,000 ppm.

9. The lubricating composition according to claim 1 wherein said composition is a natural gas engine crankcase lubricating oil.

10. The lubricating composition according to claim 1 wherein said composition is a heavy duty diesel crankcase lubricating oil.

11. The lubricating composition according to claim 1 wherein said composition is a passenger car crankcase lubricating oil.

12. A method for improving the antioxidancy and friction properties of a lubricant which comprises including in said lubricant: a) a molybdenum compound which is substantially free of reactive sulfur at a concentration of about 50 to 1000 parts per million of molybdenum; b) about 1,000 to 20,000 parts per million of an oil-soluble diarylamine; and c) about 2,000 to 40,000 parts per million of a calcium phenate.

13. The method of claim 12 wherein said molybdenum compound is an organomolybdenum complex of organic amide and the concentration of molybdenum from said molybdenum compound is from about 50 to 500 parts per million; the concentration of said diarylamine is from about 2,000 to 10,000 parts per million; and the concentration of said phenate is from about 4,000 to 30,000 parts per million.

14. The method of claim 12 wherein said molybdenum compound is at a concentration of 100 to 200 parts per million of molybdenum.

15. A lubricating oil concentrate comprising a total of from about 2.5 to 90 parts by weight of a) an oil-soluble molybdenum compound which is substantially free of reactive sulfur; b) an oil-soluble diarylamine; and c) a calcium phenate, in a solvent, wherein the weight ratio of molybdenum to diarylamine is from about 0.0025 to 1.0 part of molybdenum from the molybdenum compound for each part of diarylamine and the weight ratio of molybdenum from the molybdenum compound to the calcium phenate is about 0.00125 to 0.5.

16. The concentrate of claim 15 wherein the solvent is a mineral oil, synthetic oil or a hydrocarbon solvent, and the weight ratio of molybdenum from the molybdenum compound to diarylamine is from about 0.005 to 0.5 part of molybdenum for each part of the diarylamine and the weight ratio of molybdenum from the molybdenum compound to calcium phenate is about 0.00125 to 0.25.

17. The concentrate of claim 15 additionally comprising at least one component selected from the group consisting of dispersants, detergents, zinc dihydrocarbyl dithiophosphates, antioxidants, pour point depressants, corrosion inhibitors, rust inhibitors, foam inhibitors and friction modifiers; wherein the additional component(s) are different than components a), b) and c).

18. A lubricating oil composition prepared by mixing an oil-soluble molybdenum compound substantially free of reactive sulfur, an oil-soluble diarylamine and calcium phenate, wherein the concentration of molybdenum is from about 50 to 1000 parts per million of the composition.

19. The lubricating oil composition of claim 18 wherein said molybdenum compound is selected from the group consisting of a molybdenum amine complex, sulfur and phosphorus-free organomolybdenum complex of organic amide, molybdenum carboxylates and mixtures thereof.

20. The lubricating oil composition of claim 18 wherein:

a) said molybdenum compound is an organomolybdenum complex of organic amide;

b) said diarylamine is of the formula:

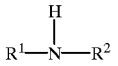

wherein $R^1$ and $R^2$ each independently represent an aryl group having from about 6 to 30 carbon atoms and the concentration thereof is from about 1,000 to 20,000 parts per million of the composition; and c) the concentration of said calcium phenate is from about 2,000 to 40,000 parts per million.

21. The lubricating oil composition according to claim 18 wherein said composition is a natural gas engine crankcase lubricating oil.

22. The lubricating oil composition according to claim 18 wherein said composition is a heavy duty diesel crankcase lubricating oil.

23. The lubricating oil composition according to claim 18 wherein said composition is a passenger car crankcase lubricating oil.

24. A method for reducing deposits in an internal combustion engine, said method comprising the step of placing in the crankcase of said engine a lubricating composition according to claim 1.

25. A method for reducing deposits in an internal combustion engine, said method comprising the step of placing in the crankcase of said engine a lubricating oil composition according to claim 18.

26. A method for reducing wear in an internal combustion engine, said method comprising the step of placing in the crankcase of said internal combustion engine a lubricating composition according to claim 1.

27. A method for reducing wear in an internal combustion engine, said method comprising the step of placing in the crankcase of said internal combustion engine a lubricating oil composition according to claim 18.

28. A method for reducing the formation of varnish in an internal combustion engine, said method comprising the steps of placing in the crankcase of said internal combustion engine a lubricating composition according to claim 1.

29. A method for reducing the formation of varnish in an internal combustion engine, said method comprising the steps of placing in the crankcase of said internal combustion engine a lubricating oil composition according to claim 18.

* * * * *